US008790443B2

(12) United States Patent
Valerio

(10) Patent No.: US 8,790,443 B2
(45) Date of Patent: Jul. 29, 2014

(54) METHOD AND SYSTEM FOR PROCESSING AN IRON ORE TAILINGS BYPRODUCT

(76) Inventor: Thomas A. Valerio, New Port Richey, FL (US)

( * ) Notice: Subject to any disclaimer, the term of this patent is extended or adjusted under 35 U.S.C. 154(b) by 58 days.

(21) Appl. No.: 13/445,468

(22) Filed: Apr. 12, 2012

(65) Prior Publication Data

US 2012/0260772 A1 Oct. 18, 2012

Related U.S. Application Data

(60) Provisional application No. 61/474,348, filed on Apr. 12, 2011.

(51) Int. Cl.
*C21B 15/00* (2006.01)
*C22B 5/00* (2006.01)
*C22B 1/00* (2006.01)

(52) U.S. Cl.
USPC ..... 75/749; 209/12.1; 210/68; 210/787

(58) Field of Classification Search
USPC ..... 75/749; 210/68, 787; 209/12.1
See application file for complete search history.

(56) References Cited

U.S. PATENT DOCUMENTS 1,933,995 A * 11/1933 Nicolet ..... 209/222
2,738,070 A * 3/1956 Cottrell ..... 209/722
2,978,100 A * 4/1961 Rodman et al. ..... 209/18

* cited by examiner

*Primary Examiner* — George Wyszomierski
*Assistant Examiner* — Tima M McGuthry Banks
(74) *Attorney, Agent, or Firm* — King & Spalding

(57) ABSTRACT

Methods and systems for processing an iron ore tailings byproduct are described. In one embodiment, a method for processing an iron ore tailings byproduct includes sizing particles within a slurry of the iron ore tailings byproduct to separate particles from the slurry having a dimension less than a predetermined size. After sizing, the method may further include centrifugating the particles less than the predetermined size into centrifugated concentrate and tails portions. The centrifugated concentrate portion may be separated into separated concentrate and tails portions. Finally, in certain embodiments, the separated concentrate portion may be de-watered to a remaining composition of matter comprising iron in greater proportion than in the iron ore tailings byproduct. Generally, using the systems and methods described herein, iron that would have otherwise been un-recovered is extracted from the iron ore tailings byproduct.

20 Claims, 2 Drawing Sheets

METHOD AND SYSTEM FOR PROCESSING AN IRON ORE TAILINGS BYPRODUCT

CROSS-REFERENCE TO RELATED APPLICATION

This application claims the benefit of U.S. Provisional Application No. 61/474,348, filed Apr. 12, 2011, the entire contents of which is hereby incorporated herein by reference.

TECHNICAL FIELD

The present invention generally relates to processing an iron ore tailings byproduct and, more particularly, processing an iron ore tailings an iron ore tailings byproduct to provide a remaining composition of matter comprising iron in greater proportion than in the iron ore tailings byproduct.

BACKGROUND

Iron ore is an important natural resource and may comprise the world's most commonly used metal. Iron may be extracted from iron ore and used in a variety of commercial applications, including the manufacture of steel. Typically, iron extraction from iron ore results in a "tailings" byproduct. This tailings byproduct still includes valuable iron that was not conventionally recovered primarily due to economic factors. Instead, this tailings byproduct was considered waste generated by mining operations. As one example, the Mesabi Iron Range is the largest of four major iron ranges in Minnesota and is the chief deposit of iron ore in the U.S. Discovered in 1866, mining operations at the Mesabi Iron Range have resulted in a large quantity of tailings byproduct. Typically, the tailings byproduct includes between 15 to 55% iron.

What is needed is a process to recover iron from an iron ore tailings byproduct, to reduce the amount of waste from mining operations, and to provide a valuable resource for the economy.

SUMMARY

Methods and systems for processing an iron ore tailings byproduct are described. In one embodiment, a method for processing an iron ore tailings byproduct includes sizing particles within a slurry of the iron ore tailings byproduct to separate particles from the slurry having a dimension less than a predetermined size. After sizing, the method may further include centrifugating the particles less than the predetermined size into centrifugated concentrate and tails portions. The centrifugated concentrate portion may be separated into separated concentrate and tails portions. Finally, in certain embodiments, the separated concentrate portion may be de-watered to a remaining composition of matter comprising iron in greater proportion than in the iron ore tailings byproduct.

In another embodiment, a system for processing an iron ore tailings byproduct is described. The system includes a screen that sizes particles within a slurry of the iron ore tailings byproduct to separate particles from the slurry having a dimension less than a predetermined size. The system may further include a centrifuge that centrifugates the particles less than the predetermined size into centrifugated concentrate and tails portions. The centrifugated concentrate may be provided to a gravity separation spiral that separates the centrifugated concentrate portion into separated concentrate and tails portions. Finally, in certain embodiments, the system may further include a filter that de-waters the separated concentrate portion to a remaining composition of matter comprising iron in greater proportion than in the iron ore tailings byproduct.

These and other aspects, objects, features, and embodiments will become apparent to a person of ordinary skill in the art upon consideration of the following detailed description of illustrative embodiments exemplifying the best mode as presently perceived.

BRIEF DESCRIPTION OF THE DRAWINGS

For a more complete understanding of the embodiments described herein, reference is now made to the following description in conjunction with the accompanying figures briefly described as follows.

Figure 1:
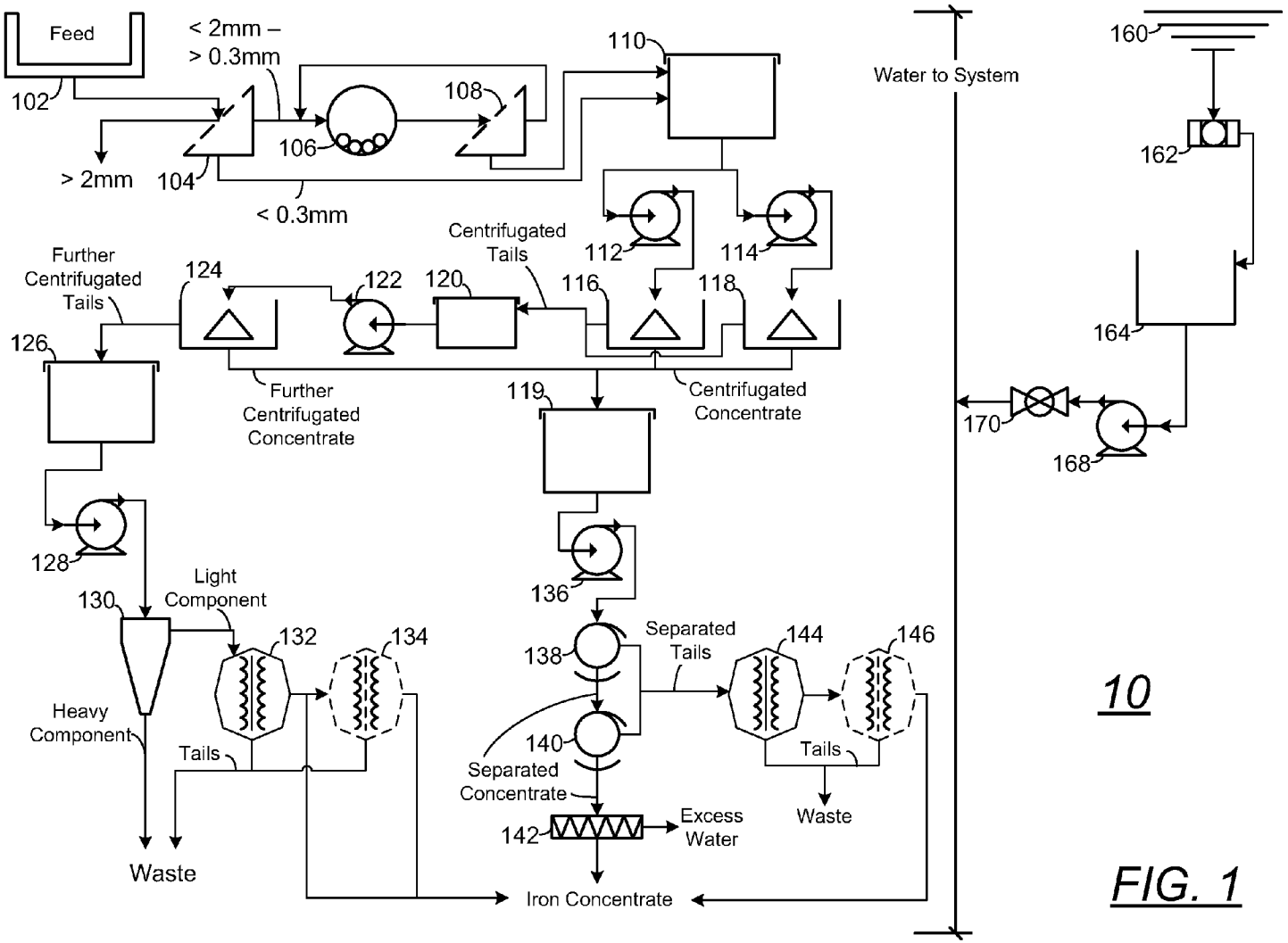
FIG. 1 illustrates an example equipment layout diagram of a system for processing iron ore tailings.

The drawings illustrate only exemplary embodiments and are therefore not to be considered limiting of its scope, as other equally effective embodiments are within the scope and spirit of this disclosure. The elements and features shown in the drawings are not necessarily drawn to scale, emphasis instead being placed upon clearly illustrating the principles of the exemplary embodiments. Additionally, certain dimensions or positionings may be exaggerated to help visually convey such principles. In the drawings, reference numerals designate like or corresponding, but not necessarily identical, elements.

DETAILED DESCRIPTION

In the following paragraphs, the embodiments are described in further detail by way of example with reference to the attached drawings. In the description, well known components, methods, and/or processing techniques are omitted or briefly described so as not to obscure the embodiments. As used herein, the "present invention" refers to any one of the embodiments of the invention described herein and any equivalents. Furthermore, reference to various feature(s) of the "present invention" is not to suggest that all embodiments must include the referenced feature(s).

Turning now to the drawings, in which like numerals indicate like elements throughout, exemplary embodiments of the invention are described in detail. FIG. 1 illustrates an example equipment layout diagram of a system 10 for processing iron ore tailings. The iron ore tailings byproduct may originate from a primary iron ore processing process, for example, and forms material for a feed 102 of the system 10. The tailings byproduct can be introduced into the system 10 via the feed 102 in a number of ways. For example, the tailings byproduct can be excavated from is current location, transported to a facility of the system 10, and mixed with water to create a slurry. In another example, the tailings byproduct can be slurred remotely from the processing facility of the system 10 and pumped to the processing facility of the system 10.

Upon being provided to the feed 102 of the system 10, the slurry tailings byproduct is introduced to a screen 104. The screen 104 sizes particles in the slurry tailings byproduct. In various embodiments, the screen 104 may comprise any type of screen suitable for the application, such as wire screens, sieves, radial sieves, multi-deck screens, vibrating screens, and flip flop screens. The screen 104 may be static or vibrate based on a mechanical vibrating means. The screen 104 may be chosen based on screen material, size, shape, and orientation, an amount of water required, vibration amplitude and frequency, and a size distribution of particles being sized in the slurry, among other aspects.

In certain exemplary embodiments, the screen 104 comprises a double-deck screen that sizes the tailings byproduct into three segmented portions or streams, each comprising a material of different size. For example, in one embodiment, the screen 104 comprises a first mesh screen that passes particles of about 2 mm in major dimension and a second, lower, mesh screen that passes particles of about 0.3 mm in major dimension. The tailings byproduct is first introduced via the feed 102 to the first mesh screen of the screen 104, and the portion of the tailings byproduct that passes through the first mesh screen continues on to be introduced to the second mesh screen of the screen 104. Based on the separation provided by the screen 104, the three segmented portions comprise (1) particles greater than about 2 mm in major dimension (i.e., material that does not pass through the first mesh screen), (2) particles between about 2 mm and 0.3 mm in major dimension (i.e., material that passes through the first mesh screen but not the second mesh screen), and (3) particles less than about 0.3 mm in major dimension (i.e., material that passes through both the first and second mesh screens). As described herein, the particles less than about 0.3 mm in major dimension comprise particles having a dimension less than a predetermined size. These particles are provided to downstream equipment for further processing.

In one embodiment, the material greater than about 2 mm in major dimension is not further processed. The material greater than about 2 mm in major dimension generally represents a fraction of the total tailings byproduct introduced to the screen 104, usually about only 2 percent of the incoming material. In an alternative embodiment, this material may be further processed in the mill 106 and then introduced to the screen 108. The material between about 2 mm and 0.3 mm in major dimension is further processed in a mill 106. The mill 106 reduces the size of the 2 mm to 0.3 mm material by comminuting the material to particles of reduces size and, thus, generally further separates iron from gangue in the material. More particularly, the mill 106 reduces the size of the 2 mm to 0.3 mm material by crushing or grinding it, thereby increasing the total overall surface area of the material. In various embodiments, the mill 106 may comprise a ball mill, vertical roller mill, hammer mill, roller press, high compression roller mill, vibration mill, or jet mill, for example, without limitation. In the exemplary embodiment of the system 10, the mill 106 comprises a ball mill.

After being reduced in size and increased in total overall surface area, material from the mill 106 is then introduced to a second screen 108. In an exemplary embodiment, the second screen 108 comprises a #60 to #80 mesh screen. Material that does not pass through the screen 108 is cycled back to the mill 106 for further processing. The material that passes through the screen 108 also comprises particles having a dimension less than the predetermined size. It is noted that the size of the particles that pass through the screen 108 may differ from the size of the particles that pass through the screen 104, although both comprise particles having a dimension less than the predetermined size. As illustrated in FIG. 1, the particles separated by the screens 104 and 106 having a dimension less than the predetermined size are collected in a holding tank 110.

The holding tank 110 may vary in size among embodiments and as necessary for the desired flow rate and throughput of the system 10. Material stored in the holding tank 110 is pumped from the holding tank 110 into a centrifuge 116 by a pump 112. The centrifuge 116 centrifugates the material stored in the holding tank 110. In one embodiment, the centrifuge 116 comprises a 100 ton per hour centrifuge based on a desired flow rate and throughput of the system 10, but other sizes of centrifuges are within the scope of this disclosure. In general, a centrifuge provides high "G-force" and low residence time. Other benefits of the centrifuge 116 include desliming the material from the holding tank 110 for downstream spiral processors, continuous production of concentrate, low maintenance (i.e., high up-time), small equipment footprint, and fully automated operation.

The centrifuge 116 offers the ability to run at different forces based on its rotational speed, which may be changed from time to time as necessary, enhancing the system 10 by providing maximum yield to downstream processes. The acceleration provided by the centrifuge 116 is measured in multiples of the "G-force," the standard acceleration due to gravity at the Earth's surface. In general, centrifugation by the centrifuge 116 uses centrifugal force to separate sedimentation from a mixture of material from the holding tank 110. Denser components of the mixture migrate away from a rotating axis of the centrifuge, while less-dense components migrate towards the axis. The rate or speed of centrifugation (i.e., separation) is determined by the angular velocity of the centrifuge 116, measured in revolutions per minute (RPM), and the size of the radius or diameter of the centrifuge 116. The rate or speed of centrifugation is also determined as a function of the size and shape of the particles in the mixture from the holding tank 110, the centrifugal acceleration of the centrifuge 116, the volume of the mixture provided from the holding tank 110, and the density difference between the particles and the liquid in the mixture from the holding tank 110, for example, among other factors.

Using the centrifuge 116 for separating or "sizing" particles, even hard-to-get particles like goethite and porous hematite can be recovered by adjusting the G-force, as necessary. Further, by adjusting the G-force of the centrifuge 116, the centrifuge 116 also provides the ability to process material with different properties or grades, to minimize downstream processing. In the exemplary embodiment of FIG. 1, two pumps 112 and 114 work in parallel to supply two centrifuges 116 and 118. In alternative embodiments, additional or fewer pumps and centrifuges may be used, depending on a desired throughput rate of the system 10.

Each of the centrifuges 116 and 118 provides two separate output streams, centrifugated concentrate and centrifugated tails portions. The centrifugated concentrate portion comprises a higher iron content than the centrifugated tails portion. The centrifugated concentrate is collected in a holding tank 119 and is further processed by downstream equipment as discussed in further detail below. The centrifugated tails from the centrifuges 116 and 118 is collected in a holding tank 120 and pumped by a pump 122 into another centrifuge 124 for further separation. In certain embodiments, the centrifuge 124 is similar to the centrifuges 116 and 118 and functions with similar operating characteristics (i.e., rotational speed or G-force). In alternative embodiments, the centrifuge 124 varies in size and/or operating characteristics as compared to the centrifuges 116 and 118. The further centrifugated concentrate from the centrifuge 124 is combined with the centrifugated concentrate from the centrifuges 116 and 118 and collected in the holding tank 119, for further processing by downstream equipment as discussed in further detail below. The further centrifugated tails from the centrifuge 124 is collected in the holding tank 126. It is noted that, among various embodiments, the holding tanks 119, 120, and 126 may vary in size as necessary for the desired flow rate and throughput of the system 10.

From the holding tank 126, the further centrifugated tails from the centrifuge 124 are pumped by pump 128 into a hydrocyclone 130. The hydrocyclone 130 is a closed vessel designed to convert incoming liquid velocity into rotary motion. Particularly, the hydrocyclone 130 converts incoming liquid velocity into rotary motion by directing inflow tangentially near a top of a vertical cylinder. As a result, the entire contents of the cylinder spin in a chamber, creating centrifugal forces in the liquid. Heavy components move outward toward the wall of the cylinder where they agglomerate and spiral down the chamber wall to an outlet at the bottom of the hydrocyclone 130. Light components move toward the center of the axis of rotation of the spinning liquid, where they move up toward an outlet at the top of the hydrocyclone 130. In various embodiments, the hydrocyclone 130 may comprise one hydrocyclone or several hydrocyclones operating in parallel or series to process the mixture from the holding tank 126, as necessary for the desired flow rate and throughput of the system 10.

The light component from the hydrocyclone 130 is provided to an ultra high gradient magnet 132 to concentrate iron within the light component. In FIG. 1, two ultra high gradient magnets 132 and 134 are illustrated in series to process the light component from the hydrocyclone 130, although it is noted that the ultra high gradient magnet 134 is optional. The ultra high gradient magnets 132 and 134 provide efficient separation of even weakly magnetic particles of small size (i.e., micron size). Generally, ultra high gradient magnets, such as magnets 132 and 134, separate ultra fine-grained magnetic particles (i.e., smaller than 10 μm in major dimension) suspended within liquids, usually with an extraction rate higher than 80%. As one example of an ultra high gradient magnet, a wire matrix is magnetized by a permanent or electro-magnet that can be activated and deactivated. The magnetic field gradients generated at the wires reliably capture small iron particles and deposit them on the wires. The particles are then flushed or mechanically removed from the wires as iron concentrate. When using both magnets 132 and 134, the magnets 132 and 134 are used in series, the first as a "rougher" magnet 132 and the second as a "cleaner" magnet 134. The cleaner magnet 134 further concentrates iron from the rougher magnet 132. The tails portion separated from the ultra high gradient magnets 132 and 134 is waste. That is, the portion of the light component from the hydrocyclone 130 that is not magnetically captured by the ultra high gradient magnets 132 and 134 is waste, as illustrated in FIG. 1. The iron concentrate from the ultra high gradient magnets 132 and 134 is one output stream of iron concentrate provided by the system 10. As described below, other output streams of iron concentrate are provided by the system 10. In general, the concentrate portion from the magnets 132 and 134 comprises a higher iron content than the tails portion.

Referring back to the centrifugated concentrate from the centrifuges 116, 118, and 124 collected in the holding tank 119, the centrifugated concentrate is pumped by a pump 136 to first "cleaner" and second "re-cleaner" gravity separation spirals 138 and 140, in series. The gravity separation spirals 138 and 140 are capable of processing large amounts of material while having a minimum amount of down time and a small footprint. In one embodiment, the spirals 138 comprise four banks of spirals each including 8 spirals, for a total of 32 spirals, although greater or fewer spirals may be used among embodiments as necessary for the desired flow rate and throughput of the system 10. Further, in one embodiment, the spirals 140 also comprise four banks of spirals each including 8 spirals, for a total of 32 spirals, although greater or fewer spirals may be used among embodiments as necessary for the desired flow rate and throughput of the system 10.

The gravity separation spirals 138 and 140 separate dense particles from the centrifugated concentrate from the holding tank 119, based upon a combination of the density and drag of the particles. In general, as larger and heavier particles travel slower down the spirals 138 and 140, they move towards the center of the spirals. In contrast, light particles migrate toward the outside of the spirals along with any water in the mixture and quickly reach the bottom. At the bottom, a "cut" may be taken by adjustable bars, channels, or slots, separating low and high density parts. The gravity separation spirals 138 and 140 may be adjusted depending on the grade of the material being processed. In contrast to centrifuges, the gravity separation spirals 138 and 140 operate with a low G-force and, when used with a centrifuge, maximize yield. The gravity separation spirals 138 and 140 also separate high concentrations of non-magnetic portions of particles present in the centrifugated concentrate from the holding tank 119, such as goethite, weakly magnetic hematite, and porous hematite. In certain aspects, using the gravity separation spirals 138 and 140 alleviates the problem of clogging magnetic separators and/or losing paramagnetic material, especially as compared to systems using magnetic separation as a single recovery system.

Each of the first and second spirals 138 and 140 provides separated concentrate and tails portions, as illustrated in FIG. 1. The separated concentrate portion from the first spirals 138 is provided to the second spirals 140, and the separated concentrate portion from the second spirals 140 is de-watered. The concentrate from the second spirals 140 is de-watered by a de-watering system 142 comprising, for example, a vacuum filter. Using the de-watering system 142, the separated concentrate from the second spirals 140 is reduced to a remaining composition of matter including a water content of less than about 12%. The remaining composition of matter also comprises approximately 63-67% iron, approximately 2-5% silicon dioxide ("silica"), and certain other elements. As the silica and other elements (i.e., other than iron) represents contaminants in the remaining composition, the system 10 is designed to minimize the amount of these elements. It is noted that the remaining composition of matter comprises iron is a greater proportion than in the iron ore tailings byproduct. The iron concentrate in the remaining composition of matter is a primary output stream of iron concentrate provided by the system 10.

The separated tails portion from the first and second spirals 138 and 140 is introduced to an ultra high gradient "rougher" magnet 144 and, in certain embodiments, to an ultra high gradient "cleaner" magnet 146. It is noted that the "cleaner" magnet 146 is optional. The ultra high gradient magnets 144 and 146 are similar to the magnets 132 and 134 and provide efficient separation of even weakly magnetic particles of small size. The tails portion separated from the ultra high gradient magnets 144 and 146 is waste, as illustrated in FIG. 1. The iron concentrate from the ultra high gradient magnets 132 and 134 comprises another output stream of iron concentrate provided by the system 10.

The system 10 comprises a wet system. In other words, water is supplied to various locations in the system 10 as necessary to allow solid materials to adequately flow through the equipment of the system. In one embodiment, water may be gathered from a pond or water dam 160, filtered by a water filter 162, such as a sieve or scalping filter, collected in a raw water tank 164, and pumped into the system 10 by a pump 168 via a value 170. As one example, water may be provided to the holding tank 110 to mix with the particles separated by the screens 104 and 108. Further, as another example, water from the water tank 164 may be mixed with the concentrates from the centrifuges 116, 118, and 124 in the holding tank 119.

The system 10 is capable of recovering iron from an iron ore tailings byproduct, reducing an amount of waste from mining operations and providing a valuable resource. It is noted that, in various embodiments, the system 10 may not comprise the equipment for providing each of the separate iron concentrate streams. For example, the system 10 may comprise the magnets 132 and 134 but not the magnets 144 and 146. In alternative embodiments of the system 10 may omit other equipment.

Figure 2:
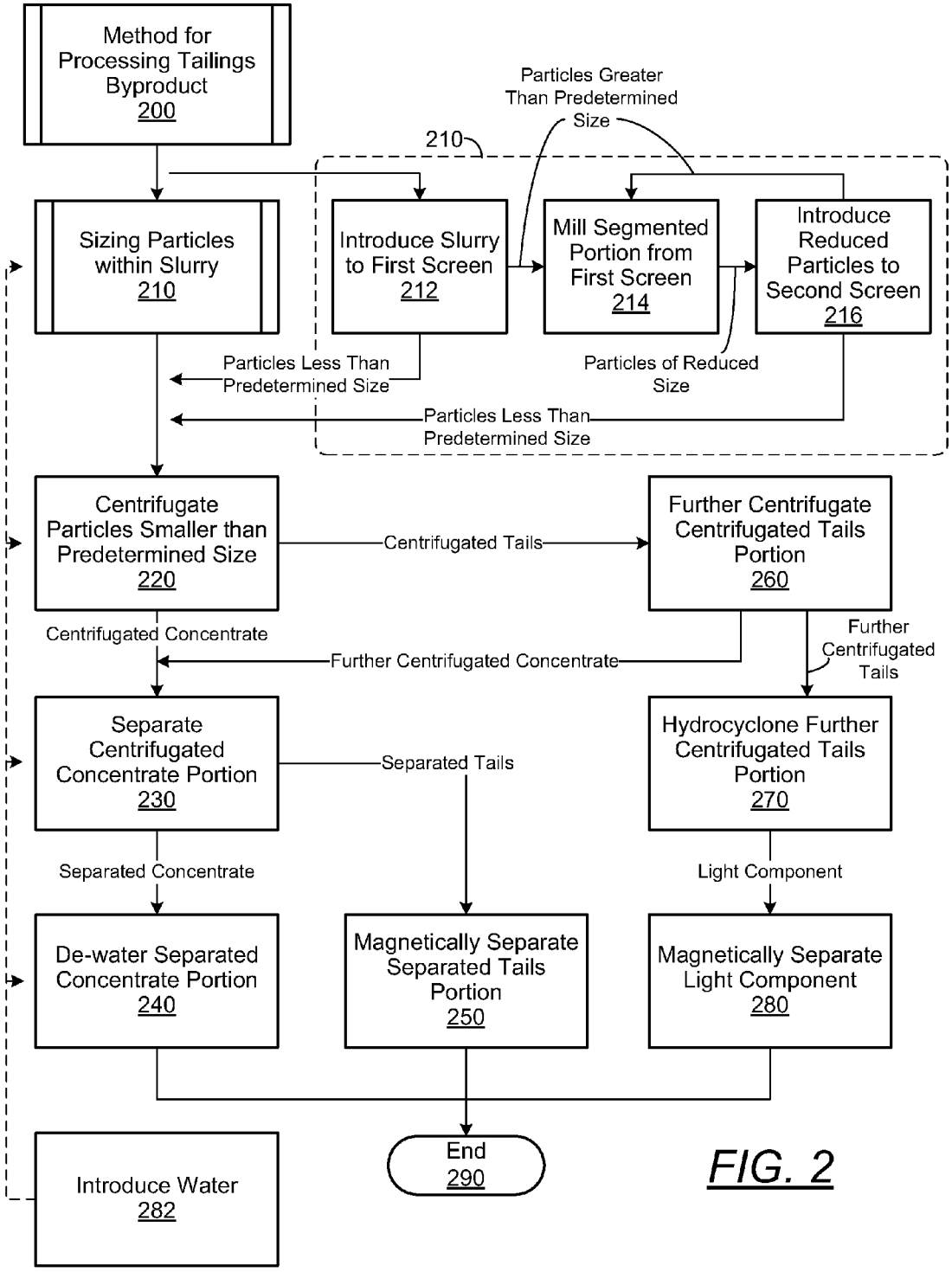
FIG. 2 illustrates an embodiment of a method of processing iron ore tailings.

Turning to the flow diagram of FIG. 2, a method of processing an iron ore tailings byproduct is described. It is noted that process may be practiced using an alternative order of the steps illustrated in FIG. 2. That is, the process flow illustrated in FIG. 2 is provided as an example only, and the present invention may be practiced using process flows that differ from that illustrated. Additionally, it is noted that not all steps are required in every embodiment. In other words, one or more of the steps may be omitted or replaced, without departing from the spirit and scope of the invention. In alternative embodiments, steps may be performed in different order, in parallel with one another, or omitted entirely, and/or certain additional steps may be performed without departing from the scope of this disclosure. It is also noted that, although the method is described with reference to the system 10 described above, the method may be performed by other equivalent systems as understood by those having skill in the art.

FIG. 2 illustrates a method 200 of processing iron ore tailings. At step 210, the method 200 begins with sizing particles within a slurry of an iron ore tailings byproduct to separate particles from the slurry having a dimension less than a predetermined size. With reference to the system 10 of FIG. 1, step 210 may be performed using the screen 104, for example, which separates particles having a dimension less than a predetermined size from a slurry provided via the feed 102. In one embodiment, the predetermined size may be about 0.3 mm in major dimension, although other sizes are within the scope of this disclosure. As such, in one embodiment, step 210 sizes particles to separate particles having a dimension less than about 0.3 mm in major dimension. The particles having the dimension less than the predetermined size are provided for processing in further steps.

Sizing particles at step 210 may, in certain embodiments, include several steps of sizing particles. For example, as further illustrated in FIG. 2, step 210 may include the steps of introducing a slurry to a first screen that sizes the iron ore tailings byproduct into segmented portions of particles having different respective sizes at step 212, milling at least one portion of the segmented portions of particles having a dimension greater than the predetermined size at step 214 to provide particles of reduced size, and introducing the particles of reduced size to a second screen at step 216. More particularly, step 212 may include sizing the slurry with a double-deck screen, such as the double deck screen 104, that sizes the tailings byproduct into three segmented portions of particles having different respective sizes. In one embodiment, the three segmented portions of particles include (1) a segmented portion of particles having the dimension less than the predetermined size, which is about 0.3 mm in major dimension, (2) a segmented portion of particles having a major dimension between about 0.3 mm and 2 mm, and (3) a segmented portion of particles having a major dimension greater than 2 mm. In other embodiments, each of the segmented portions of particles may be defined by respective different sizes, depending upon the characteristics of the screen(s) used at step 212. After step 212, the segmented portion of particles having the dimension less than the predetermined size are provided for processing in later steps, as illustrated in FIG. 2.

One or more of the portions of segmented particles having a dimension greater than the predetermined size are milled at step 214 to reduce those particles into particles of reduced size. With reference to FIG. 1, step 212 may be performed by the mill 106. After milling at step 214, the particles of reduced size are introduced to a second screen at step 216. At step 216, the particles of reduced size are separated into further segmented portions of particles having different respective sizes, at least one portion of the further segmented portions comprising particles having a dimension less than the predetermined size. In certain embodiments of the method 200, step 216 may be performed using the screen 108. Of the further segmented portions of particles separated at step 216, the particles having a dimension less than the predetermined size are provided for processing in later steps, as illustrated in FIG. 2, and the particles having a dimension greater than the predetermined size are provided back to step 214 for further milling. It is noted that, in various embodiments, the size of the openings in the screens used in steps 212 and 216 may differ. As such, the size of the segmented portion of particles having a dimension less than the predetermined size which is separated at step 212 may differ from the size of such particles separated at step 216.

After sizing particles within the slurry at step 210, the particles smaller than the predetermined size are centrifugated at step 220 into centrifugated concentrate and tails portions. Centrifugating the particles at step 220 may be performed by the centrifuges 116 and, in certain embodiments, 118. After step 220, the method 200 proceeds to step 230 where the centrifugated concentrate portion is separated into separated concentrate and tails portions. Referring to FIG. 1, the gravity separation spirals 138 and, in certain embodiments, 140 may be used at step 230 to separate the centrifugated concentrate portion into separated concentrate and tails portions.

After separating the centrifugated concentrate at step 230, the method 200 proceeds to step 240 where the separated concentrate portion is de-watered to a remaining composition of matter comprising iron in greater proportion than in the iron ore tailings by product. With reference to FIG. 1, the separated concentrate portion may be de-watered by the de-watering system 142, which may comprise a vacuum filter in certain embodiments. The remaining composition of matter provided after de-watering comprises one concentrated stream of iron output by the method 200. After water is removed at step 240, the method 200 ends at step 290.

In certain embodiments, the method 200 further comprises additional steps to further process the tailings by product. For example, at step 260, the method 200 may further comprise the step of centrifugating the centrifugated tails portion from step 220 into further centrifugated concentrate and tails portions. With reference to FIG. 1, the centrifuge 124 may be used to further centrifugate the centrifugated tails portion provided by the centrifuges 116 and, in certain embodiments, 118. That is, the centrifugated tails portion from the centrifuges 116 and 118 may be further centrifugated at step 260 to provide further centrifugated concentrate and tails portions. As illustrated in FIG. 2, the further centrifugated concentrate portion from step 260 may be combined with the centrifugated concentrate portion from step 220 to provide a combined centrifugated concentrate portion. In this case, the combined centrifugated concentrate portion may be separated at step 230.

In embodiments that further process the tailings byproduct, at step 270, the further centrifugated tails portion is hydrocycloned to separate the further centrifugated tails portion into light and heavy components. Particularly, while the further centrifugated concentrate from step 260 is provided for separating at step 230, the further centrifugated tails portion from step 260 is provided to the step of hydrocycloning the further centrifugated tails portion at step 270. Referring to FIG. 1, the hydrocyclone 130 may be used to perform the step of hydrocycloning the further centrifugated tails portion to separate the further centrifugated tail portion into light and heavy components.

After hydrocycloning at step 270, the method 200 proceeds to step 280, where the light component from the hydrocycloning is magnetically separated to provide a concentrate of iron. With reference to FIG. 1, the ultra high gradient magnet 132 and, in certain embodiments, the ultra high gradient magnet 134 may be used to perform the step of magnetically separating the light component from step 270 at step 280. The magnetically separated concentrate of iron provided at step 270 comprises another concentrated stream of iron output by the method 200.

In certain embodiments, after the step of separating the centrifugated concentrate portion at step 230, the method 200 further includes the step of magnetically separating the separated tails portion at step 250. In other words, the separated tails portion from the step of separating the centrifugated concentrate portion at step 230 may be provided to step 250, where iron is magnetically separated from the separated tails portion using an ultra high gradient magnet. Again, with reference to FIG. 1, the ultra high gradient magnet 144 and, in certain embodiments, the ultra high gradient magnet 146 may be used to perform the step of magnetically separating the separated tails portion at step 250. It is noted that both steps 250 and 280 may be performed by one or more ultra high gradient magnets, in various embodiments. The magnetically separated concentrate of iron provided at step 250 comprises another concentrated stream of iron output by the method 200.

As discussed above, water may be required for certain steps of the method 200. As such, the method 200 may further include the step 282 of introducing water among one or more of the steps of sizing particles within the slurry at step 210, centrifugating the particles smaller than a predetermined size at step 220, separating the centrifugated concentrate portion at step 230, and de-watering the separated concentrate portion at step 240. The water may be provided, as necessary, to flow particles through the steps of the method 200.

Although embodiments of the present invention have been described herein in detail, the descriptions are by way of example. The features of the invention described herein are representative and, in alternative embodiments, certain features and elements may be added or omitted. Additionally, modifications to aspects of the embodiments described herein may be made by those skilled in the art without departing from the spirit and scope of the present invention defined in the following claims, the scope of which are to be accorded the broadest interpretation so as to encompass modifications and equivalent structures.

The invention claimed is:

1. A method for processing a byproduct comprising iron ore and tailings, comprising:

sizing particles within a slurry of the iron ore tailings byproduct to separate particles from the slurry having a dimension less than a predetermined size, centrifugating the particles less than the predetermined size into centrifugated concentrate and tails portions;

separating the centrifugated concentrate portion into separated concentrate and tails portions; and de-watering the separated concentrate portion to a remaining composition of matter comprising iron in greater proportion than in the iron ore tailings byproduct.

2. The method for processing an iron ore tailings byproduct of claim 1, wherein sizing particles within the slurry comprises introducing the slurry to a first screen that sizes the iron ore tailings byproduct into segmented portions of particles having different respective sizes, the segmented portions of particles including a segmented portion of particles having a dimension less than the predetermined size; and milling at least one portion of the segmented portions of particles having a dimension greater than the predetermined size, to provide particles of reduced size.

3. The method for processing an iron ore tailings byproduct of claim 2, wherein sizing particles within the slurry further comprises introducing the particles of reduced size to a second screen that sizes the particles of reduced size into further segmented portions of particles having different respective sizes, at least one portion of the further segmented portions comprising particles having a dimension less than the predetermined size.

4. The method for processing an iron ore tailings byproduct of claim 1, further comprising centrifugating the centrifugated tails portion into further centrifugated concentrate and tails portions; and combining the centrifugated concentrate portion with the further centrifugated concentrate portion to provide a combined centrifugated concentrate portion, wherein separating the centrifugated concentrate portion comprises separating the combined centrifugated concentrate portion into the separated concentrate and tails portions.

5. The method for processing an iron ore tailings byproduct of claim 4, further comprising hyrdrocycloning the further centrifugated tails portion to separate the further centrifugated tails portion into light and heavy components.

6. The method for processing an iron ore tailings byproduct of claim 5, further comprising magnetically separating particles in the light component to provide a concentrate of iron from the light component.

7. The method for processing an iron ore tailings byproduct of claim 6, wherein magnetically separating comprises magnetically separating the light component using a magnet.

8. The method for processing an iron ore tailings byproduct of claim 1, wherein separating the centrifugated concentrate portion into separated concentrate and tails portions comprises separating the centrifugated concentrate portion using at least one bank of gravity separation spirals.

9. The method for processing an iron ore tailings byproduct of claim 1, further comprising magnetically separating iron from the separated tails portion using a magnet.

10. The method for processing an iron ore tailings byproduct of claim 1, wherein separating the centrifugated concentrate portion into separated concentrate and tails portions comprises separating the centrifugated concentrate portion using a combination of a cleaner bank of gravity separation spirals and a re-cleaner bank of gravity separation spirals.

11. The method for processing an iron ore tailings byproduct of claim 1, further comprising a step of introducing water into the iron ore tailings byproduct prior to de-watering the separated concentrate portion to a remaining composition of matter.

12. A method for processing an iron ore tailings byproduct, comprising:

sizing particles within a slurry of the iron ore tailings byproduct to separate particles from the slurry having a dimension less than a predetermined size, centrifugating the particles less than the predetermined size into centrifugated concentrate and tails portions;

centrifugating the centrifugated tails portion into further centrifugated concentrate and tails portions;

combining the centrifugated concentrate portion with the further centrifugated concentrate portion to provide a combined centrifugated concentrate portion;

separating the combined centrifugated concentrate portion into separated concentrate and tails portions; and de-watering the separated concentrate portion to a remaining composition of matter comprising iron in greater proportion than in the iron ore tailings byproduct.

13. The method for processing an iron ore tailings byproduct of claim 12, further comprising hyrdrocycloning the further centrifugated tails portion to separate the further centrifugated tails portion into light and heavy components.

14. The method for processing an iron ore tailings byproduct of claim 13, further comprising magnetically separating particles in the light component to provide a concentrate of iron from the light component.

15. The method for processing an iron ore tailings byproduct of claim 14, wherein magnetically separating comprises magnetically separating the light component using a magnet.

16. The method for processing an iron ore tailings byproduct of claim 13, wherein sizing particles within the slurry comprises introducing the slurry to a first screen that sizes the iron ore tailings byproduct into segmented portions of particles having different respective sizes, the segmented portions of particles including a segmented portion of particles having a dimension less than the predetermined size; and milling at least one portion of the segmented portions of particles having a dimension greater than the predetermined size, to provide particles of reduced size.

17. The method for processing an iron ore tailings byproduct of claim 16, wherein sizing particles within the slurry further comprises introducing the particles of reduced size to a second screen that sizes the particles of reduced size into further segmented portions of particles having different respective sizes, at least one portion of the further segmented portions comprising particles having a dimension less than the predetermined size.

18. The method for processing an iron ore tailings byproduct of claim 12, wherein separating the centrifugated concentrate portion into separated concentrate and tails portions comprises separating the centrifugated concentrate portion using at least one bank of gravity separation spirals.

19. The method for processing an iron ore tailings byproduct of claim 12, further comprising magnetically separating iron from the separated tails portion using a magnet.

20. A method for processing an iron ore tailings byproduct, comprising:

sizing particles within a slurry of the iron ore tailings byproduct to separate particles from the slurry having a dimension less than a predetermined size, centrifugating the particles less than the predetermined size into centrifugated concentrate and tails portions;

centrifugating the centrifugated tails portion into further centrifugated concentrate and tails portions;

combining the centrifugated concentrate portion with the further centrifugated concentrate portion to provide a combined centrifugated concentrate portion;

separating the combined centrifugated concentrate portion into separated concentrate and tails portions;

hyrdrocycloning the further centrifugated tails portion to separate the further centrifugated tails portion into light and heavy components;

magnetically separating particles in the light component to provide a concentrate of iron from the light component, wherein magnetically separating comprises magnetically separating the light component using a magnet; and de-watering the separated concentrate portion to a remaining composition of matter comprising iron in greater proportion than in the iron ore tailings byproduct.

* * * * *